US005550321A

United States Patent [19]

Brann

[11] Patent Number: 5,550,321

[45] Date of Patent: Aug. 27, 1996

[54] FOOT OPERATED ELECTRONIC MUSICAL APPARATUS

[76] Inventor: William A. Brann, P.O. Box 1025, Montross, Va. 22520

[21] Appl. No.: 355,250

[22] Filed: Dec. 9, 1994

[51] Int. Cl.[6] ..... G10H 1/32

[52] U.S. Cl. ..... 84/721; 84/746; 84/DIG. 25

[58] Field of Search ..... 84/718, 721, 743, 84/746, DIG. 25

[56] References Cited

U.S. PATENT DOCUMENTS

| | | | |
|---|---|---|---|
| 3,432,607 | 3/1969 | Bergman . | |
| 3,433,881 | 3/1969 | Cotten . | |
| 3,530,224 | 9/1970 | Plunkett et al. . | |
| 3,585,893 | 6/1971 | Arseneault . | |
| 3,603,192 | 9/1971 | Kaar | 84/267 |
| 4,046,049 | 9/1977 | Luce et al. | 84/DIG. 25 |
| 4,491,050 | 1/1985 | Franzmann | 84/DIG. 25 |
| 4,744,279 | 5/1988 | Livingston | 84/746 |
| 5,166,467 | 11/1992 | Brown | 84/721 X |

*Primary Examiner*—William M. Shoop, Jr.
*Assistant Examiner*—Jeffrey W. Donels
*Attorney, Agent, or Firm*—Richard C. Litman

[57] ABSTRACT

A foot operated electronic musical instrument with a plurality of foot actuated pedals, which correspond to the notes produced by a bass guitar. Depressing a particular pedal causes an electronic tone generator to produce a corresponding note. Pedals are generally provided only for natural notes, with the exception of A# and D#. In order to obtain the full chromatic scale, a flat switch is included. When engaged by the foot this switch has the effect of lowering the value of the note by one half step, hence adding a flat, or a sharp with respect to the next lower note.

11 Claims, 3 Drawing Sheets

FOOT OPERATED ELECTRONIC MUSICAL APPARATUS

1. Field of the Invention

The present invention relates generally to musical instruments and more particularly to foot operated electronic musical devices.

2. Background of the Invention

In the field of musical performance, it is often desirable, if not necessary, to have bass accompaniment with the performance or practice of particular selections. In today's competitive economic environment it is often financially unfeasible for a musical performance group to have a separate musician providing this accompaniment. A need has arisen to provide a simple method for allowing an individual to provide his or her own bass accompaniment while playing another musical instrument, or to use such a device in a solo situation either in practice or performance.

3. Description of the Prior Art

Several attempts have been made to allow a musician to control one musical function with his or her hands and a separate function with the feet. It is well known and well established to provide pianos with pedals which control the amount of damping applied to the piano strings. With the advent of electronic organs this function was copied and expanded, giving the organist a wide variety of control functions with the foot pedals. The concept of controlling the musical characteristics of a particular instrument with foot pedals has expanded to include other instruments.

U.S. Pat. No. 3,530,224, issued to Plunkett et al. on Sep. 22, 1970, discloses a foot pedal which is able to change the tonal qualities of the input signal of an existing instrument, and U.S. Pat. No. 5,166,467, issued to T. M. Brown on Nov. 24, 1992, provides a means to control some preset functions of a standard electronic keyboard with foot controlled pedals. None of these devices provide the musician a separate and distinct musical instrument with which to perform.

It is not unknown to attach a plurality of pedals to an independent tone producing device to create a separate and distinct instrument. U.S. Pat. No. 3,432,607, issued to S. H. Bergman on Mar. 11, 1969, illustrates such a device, but it must be attached to twenty-three independent pedals to provide the desired musical functions. U.S. Pat. Nos. 3,433,881, issued to R. M. Cotten on Mar. 18, 1969 and 3,585,893, issued to J. P. Arseneault on Jun. 22, 1971, both disclose similar tone producing devices which are controlled by a plurality of foot pedals. The Cotten device requires four rows of pedals with nine pedals per row, and the Arseneault device requires twenty-four pedals to produce the desired effect.

None of the above inventions and patents, taken either singly or in combination, is seen to describe the instant invention as claimed.

SUMMARY OF THE INVENTION

The present invention relates to an improved foot controlled tone producing device which overcomes the above noted shortcomings and offers a simple yet versatile system to provide a full spectrum of tones. The present invention accomplishes this by providing only a minimal number of tone producing pedals which represent the natural notes and an additional pedal named herein a "a flat switch " which, when engaged, has the effect of lowering a selected note or tone by one half step to obtain natural notes, flats or sharps. Further, the device is structured to allow all relevant operational controls to be engaged by the foot, such as the volume control and the flat switch.

Accordingly, it is an object of the invention to provide a tone generating device which is exclusively operated by foot actuated pedals.

It is another object of the invention to provide a foot pedal operated tone producing device consisting of a minimum number of pedals to provide a full spectrum of tones.

It is a further object of the invention to provide a foot pedal operated tone producing device which has a flat switch for lowering the value of a selected tone by one half step.

Still another object of the invention is to provide a foot pedal operated tone producing device which has foot operated controls for all relevant controls, such as the volume control and the flat switch.

An additional object of the invention is to provide a foot pedal operated tone producing device configured in such a manner as to allow the simultaneous use of this instrument with any hand operated instrument.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
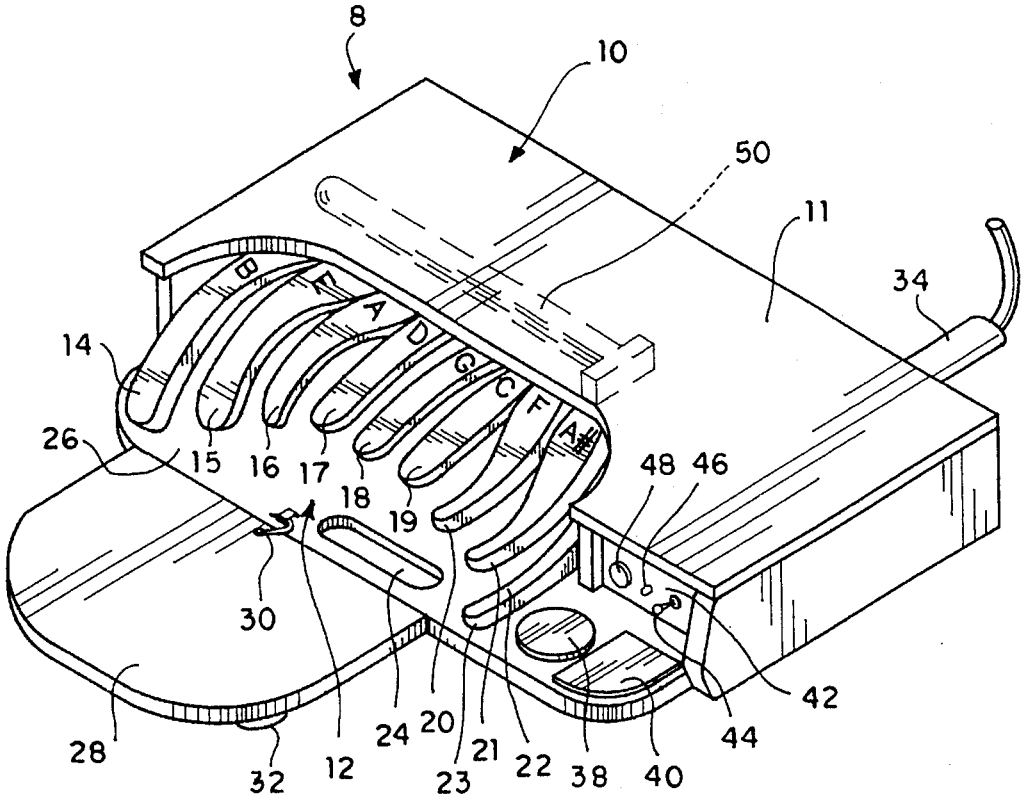
FIG. 1 is a front perspective view of the instrument according to the invention.

Turning now to FIG. 1 of the drawings, a musical instrument 8 according to the invention is shown. The instrument has a generally rectangular housing 10, which has an open frontal area 12 from which a plurality of pedals 14–22 project, and a top or cover portion 11. The tips 23 of the pedals form a concave arc across the open front area 12. Centered in front of pedals 14–22 is a carrying handle 24 which may be formed as a cutout in the base plate 26. Extending across the length of the open front section 12 is a removably attachable heel rest 28 that is held in place by a suitable clasp mechanism 30. Attached to the underside of the heel rest 28 at each of the corners are rubber pads or bumpers 32. The user may rest his foot on the heel rest 28 and position his toes over the pedals 14–22 to allow for a convenient and comfortable arrangement. Protruding from the housing of the instrument is an output jack 34 and an output cable 36, which lead to an external bass amplifier or other similar device.

Located at the corner of the base plate 26 are the volume control switch 38 and the flat switch 40. Immediately behind these switches is a vertical support member 42 housing a power switch 44, a power indicator light 46 and a pedal lighting switch 48. The lighting switch 48 activates the lighting mechanism 50 which illuminates the pedals 14–22. The lighting mechanism 50 is appropriately mounted underneath the top portion 11 of the housing 10.

Figure 2:
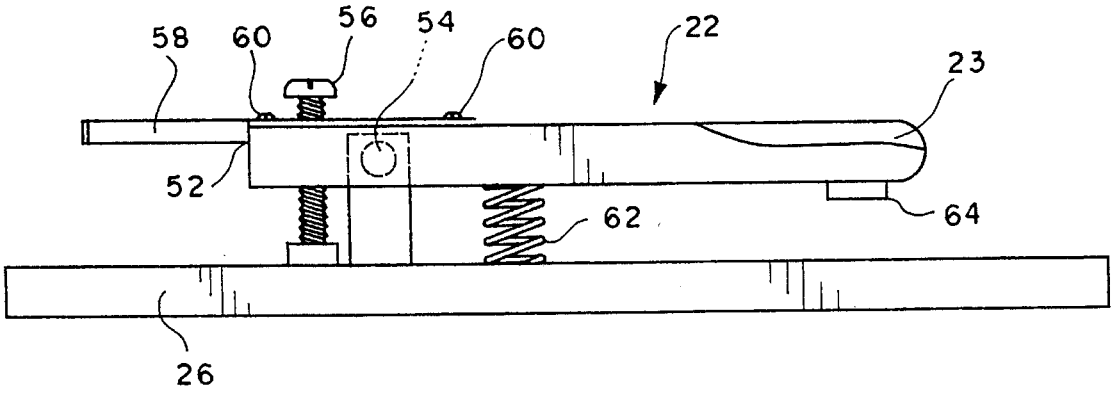
FIG. 2 is a side elevational view, partly in section, of an individual pedal assembly.

Turning now to FIG. 2, which is a side view of one of the pedals 14–22 attached to the base plate 26 of the housing 10, the selected pedal 22 will be seen to include a rigid horizontal member attached to a pivot point 54 near its distal end 52. To the rear of this pivot point 54 is a screw type height adjustment mechanism 56. Also attached at the posterior end of the pedal 52 is a metallic rocker vane 58 which acts as a switching mechanism. The rocker vane 58 is secured to the pedal 22 by two screws 60,60 located on either side of the height adjustment screw 56. A return, coil compression spring 62 is positioned beneath the pedal 22 which returns the pedal to its original position after the pedal is depressed and then released. Although a coil compression spring 62 is illustrated, other suitable spring returns or the like might be employed (not shown). A rubber stop 64 is located on the lower side of the proximate tip 66 of the pedal 22, for preventing the pedal from coming into contact with the base plate 26 when depressed.

Figure 3:
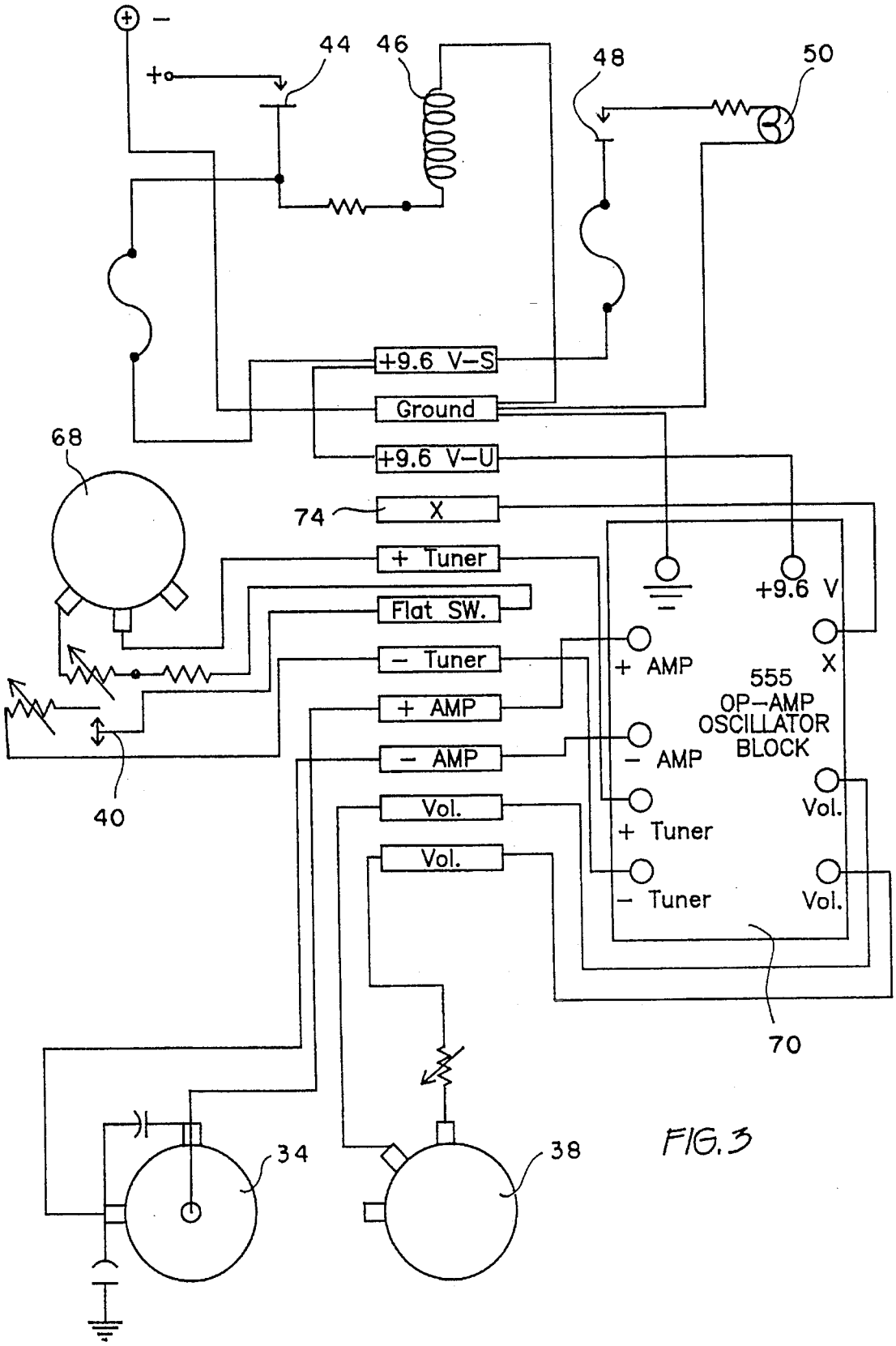
FIG. 3 is a circuit diagram.

FIG. 3 is a circuit diagram of the instrument and is substantially comprised of basic electrical elements as shown. In addition, a tuning mechanism 68 is attached to allow the oscillating mechanism 70 to be adjusted according to particular musical requirements.

Figure 4:
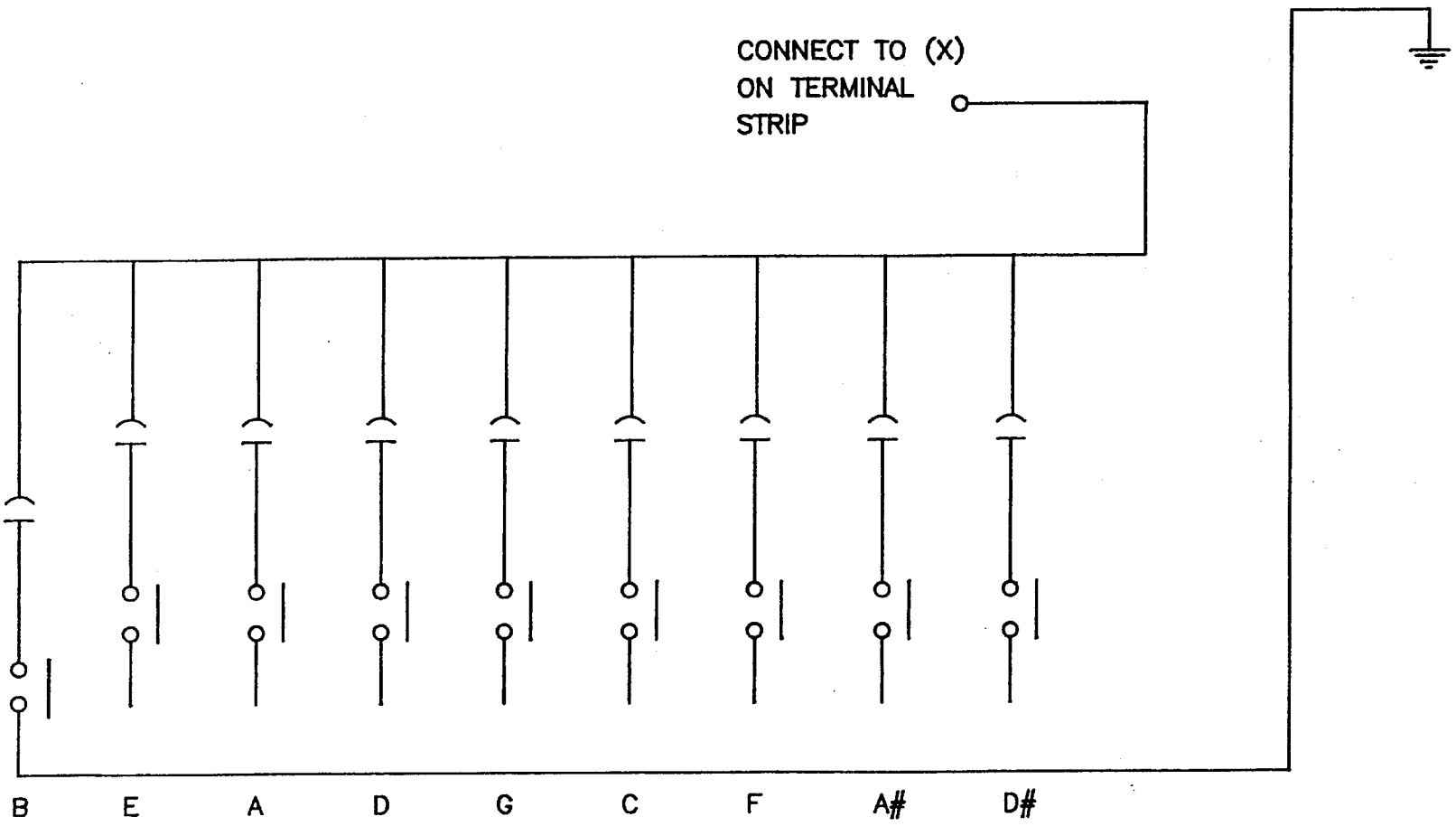
FIG. 4 is a circuit diagram of the switching apparatus.

The pedal switching is operated by depressing the tip 23 of a pedal with the left foot. This causes the steel rocker vane 58, which blocks a magnetic flux in the reed switching mechanism of the tone module, shown in FIG. 4, to rise, allowing the magnetic flux to activate that particular reed switch causing the circuit shown in FIG. 3 to produce the desired tone. One side of the tone module is connected to the oscillator circuit shown in FIG. 3 at the contact 74, marked as X on the terminal strip. The opposite side of the tone module is grounded. Releasing the pedal 22 allows the spring 62 to return the pedal to its original position, thus lowering the rocker vane 58 and again blocking the magnetic flux that activates that particular reed switch in FIG. 4.

While operating the instrument 8, the user will sit on a high stool and place his left foot on the heel rest 28 portion in such a way as to allow the foot to depress the pedals 14–22. The right foot is then free to operate the volume control 38 and the flat switch 40. In this configuration the user may also operate a second instrument with his hands at the same time he is using the present device. For a left handed person, the construction and method for the playing the device would be reversed. When the foot depresses a particular pedal 14–22 the corresponding circuitry is activated and a tone is produced. The user has a full scale available to be played, with the pedals 14–22 corresponding to the following sequence: B,E,A,D,G,C,F,A#,D#. When the musician using the device wishes to play a note not directly corresponding to the pedals 14–22, the flat switch 40 is depressed by one foot and the other foot engages the pedal 14–22 which corresponds to a note one half step above the note desired. The flat switch 40 lowers a selected musical note value by one half step, thus allowing the pedal configuration to adequately represent a full scale. The pedals 21–22 which correspond to the notes A# and D# respectively, are not necessary for the instrument 8 to achieve its full range, but make it easier to play the instrument 8 in particular keys.

It is to be understood that the present invention is not limited to the sole embodiment described above, but encompasses any and all embodiments within the scope of the following claims.

I claim:

1. A foot operated musical apparatus for producing tones comprising:

a housing including a plurality of foot operated primary actuators extended from and supported by said housing, and a tone generating switch for each actuator, each actuator and switch combination representing a natural note of the chromatic scale;

a foot operated flat switch adjacent said primary actuators, an electronic tone generator; and circuitry means joining said switches to said tone generator; whereby sharps and flats between the natural notes are played by operating said flat switch, thus obviating any need for actuators representing sharps and flats to be disposed intermediate adjacent ones of the primary actuators.

2. A foot operated musical apparatus for producing tones according to claim 1, wherein said primary actuators include pedals.

3. A foot operated musical apparatus for producing tones according to claim 2, wherein each of said pedals includes a free end, and said free ends of said pedals are dimensioned, configured and arranged so as to define a concave arc.

4. A foot operated musical apparatus for producing tones according to claim 1, wherein said primary actuators represent, left to right, the natural notes B,E,A,D,G,C and F.

5. A foot operated musical apparatus for producing tones according to claim 4, including supplemental actuators representing the notes A# and D# and disposed intermediate said primary actuators and said flat switch.

6. A foot operated musical apparatus for producing tones according to claim 1, including lighting means in said housing for illuminating said primary actuators.

7. A foot operated musical apparatus for producing tones according to claim 1, wherein said housing includes a removably attachable heel rest.

8. A foot operated musical apparatus for producing tones comprising:

a housing including a removably attachable heel rest, a plurality of foot operated primary actuator pedals extended from and supported by said housing, and a tone generating switch for each pedal, each pedal and switch combination representing a natural note of the chromatic scale;

a foot operated flat switch adjacent said primary actuators;

an electronic tone generator;

circuits joining said switches to said tone generator; and lighting means in said housing for illuminating said primary actuators; whereby sharps and flats between the natural notes are played by operating said flat switch, thus obviating any need for actuators representing sharps and flats to be disposed intermediate adjacent ones of the primary actuators.

9. A foot operated musical apparatus for producing tones according to claim 8, wherein said primary actuators represent, left to right, the natural notes B,E,A,D,G,C and F.

10. A foot operated musical apparatus for producing tones according to claim 9, including supplemental actuators representing the notes A# and D# and disposed intermediate said primary actuators and said flat switch.

11. A foot operated musical apparatus for producing tones according to claim 8, wherein each of said pedals includes a free end, and said free ends of said pedals are dimensioned, configured and arranged so as to define a concave arc.

* * * * *